US010206475B2

(12) United States Patent
Pusey

(10) Patent No.: US 10,206,475 B2
(45) Date of Patent: Feb. 19, 2019

(54) GAMING AND ADVERTISEMENT BACKPACK

(71) Applicant: Michcail A. Pusey, San Francisco, CA (US)

(72) Inventor: Michcail A. Pusey, San Francisco, CA (US)

( * ) Notice: Subject to any disclaimer, the term of this patent is extended or adjusted under 35 U.S.C. 154(b) by 0 days.

(21) Appl. No.: 15/958,158

(22) Filed: Apr. 20, 2018

(65) Prior Publication Data

US 2018/0303213 A1 Oct. 25, 2018

Related U.S. Application Data

(60) Provisional application No. 62/487,633, filed on Apr. 20, 2017.

(51) Int. Cl.

| | |
|---|---|
| ***A45C 13/02*** | (2006.01) |
| ***A45C 13/00*** | (2006.01) |
| ***A45F 3/02*** | (2006.01) |
| *A45F 3/00* | (2006.01) |

(52) U.S. Cl.

CPC ..... *A45C 13/02* (2013.01); *A45C 13/001* (2013.01); *A45C 13/002* (2013.01); *A45F 3/02* (2013.01); *A45C 2013/025* (2013.01); *A45F 2003/003* (2013.01); *A45F 2200/0516* (2013.01); *A45F 2200/0525* (2013.01)

(58) Field of Classification Search

CPC ..... A45F 3/04; A45F 2003/003; A45F 3/02; A45F 2200/0516; A45F 2200/0525; A45C 15/00; A45C 13/02; A45C 13/001; A45C 13/002; A45C 2013/025

See application file for complete search history.

(56) References Cited

U.S. PATENT DOCUMENTS

| | | | | |
|---|---|---|---|---|
| 9,992,574 | B2 * | 6/2018 | Esses | H04R 3/12 |
| 2002/0088726 | A1 * | 7/2002 | Chou | A45F 3/04 206/320 |
| 2005/0264543 | A1 * | 12/2005 | Gorischek | G09F 21/02 345/204 |
| 2006/0163303 | A1 * | 7/2006 | Trutanich | A45F 3/04 224/576 |
| 2007/0216600 | A1 * | 9/2007 | Langlois | G09F 21/02 345/8 |
| 2008/0011799 | A1 * | 1/2008 | Chang | A45C 15/00 224/576 |
| 2013/0169069 | A1 * | 7/2013 | Stone | H02J 1/00 307/150 |
| 2016/0007719 | A1 * | 1/2016 | Harstvedt | A45F 3/04 224/645 |
| 2017/0262884 | A1 * | 9/2017 | Miller | A41D 1/04 |
| 2018/0063312 | A1 * | 3/2018 | Jong | H04M 1/7253 |

* cited by examiner

*Primary Examiner* — Corey N Skurdal
(74) *Attorney, Agent, or Firm* — Dunlap Bennett & Ludwig PLLC

(57) ABSTRACT

A backpack includes a bag having a front, a back, a top, a bottom, a first side, a second side and at least one inner compartment defined within. At least one connector is operable to open and close an opening to the inner compartment of the bag. The backpack further includes at least one shoulder strap coupled to the bag and disposed over the back of the bag. A portable computer, including a processor, a memory, and a display screen, is attached to the front of the bag.

8 Claims, 3 Drawing Sheets

GAMING AND ADVERTISEMENT BACKPACK

CROSS-REFERENCE TO RELATED APPLICATION

This application claims the benefit of priority of U.S. provisional application No. 62/487,633, filed Apr. 20, 2017, the contents of which are herein incorporated by reference.

BACKGROUND OF THE INVENTION

The present invention relates to a backpack and, more particularly, to a gaming and advertisement backpack.

There are a lot of gamers that play games on their portable computer, such as a smart phone or tablet. Sometimes it is hard to hold the for a long period of time with your hands. The user may also hurt their necks by looking down at the game for too long. The screens of smart phones are also small and some users want to play on a bigger screen, such as a tablet, but as mentioned above, tablets are large and difficult to hold for a long period of time.

Additionally, some users want to showcase there projects or business while on the go but don't have the means to do so.

As can be seen, there is a need for a gaming and advertisement backpack.

SUMMARY OF THE INVENTION

In one aspect of the present invention, a backpack comprises: a bag comprising a front, a back, a top, a bottom, a first side and a second side; at least one connector operable to open and close an opening to an inner compartment of the bag; at least one shoulder strap coupled to the bag and disposed over the back of the bag; a frame coupled to the front of the bag, wherein the frame defines a slot; and a portable computer comprising a processor, a memory, and a display screen, wherein the portable computer is retained to the frame within the slot.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a backpack with a portable computer holder or a built in flexible display that is located on the posterior of the backpack. The present invention may further include a removable BLUETOOTH® speaker, a global positioning system (GPS) tracker, a pocket for a gaming controller, an integrated lock, secure locking point, hidden pockets, TSA approved tablet and laptop compartment that open flat, retractable key leash, luggage handle for traveling, sternum strap, strap holder, reflective front cover, cooling material, and a built-in air vent.

Using the present invention, a user may store their portable computer or flexible display in the backpack and use the backpack as a tablet stand. With the game controller pocket, the user may store a wireless game controller and then remove the controller and use the controller for gaming on the tablet. The present invention may also be used to advertise a business, by playing advertisements on the portable computer or screen while walking around.

Figure 1:
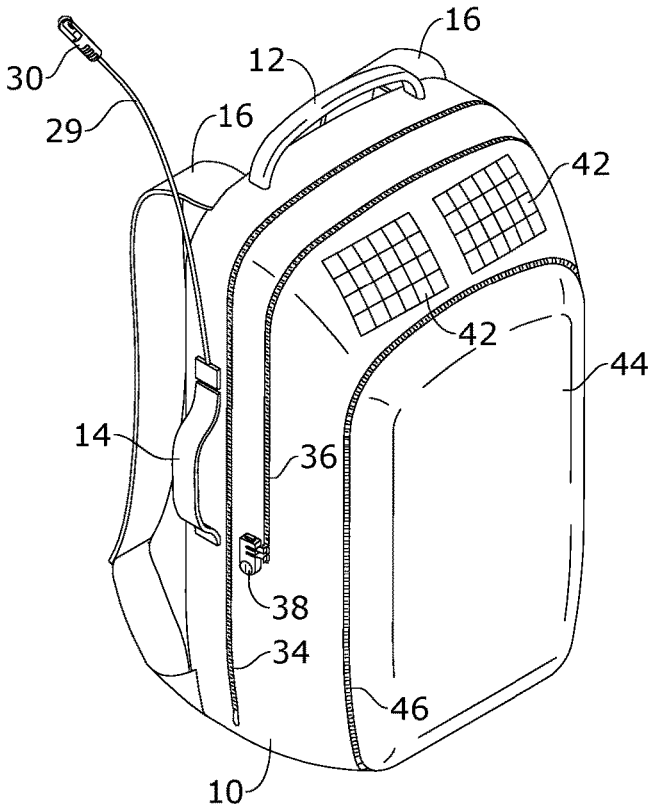
FIG. 1 is a front perspective view of an embodiment of the present invention.
Figure 2:
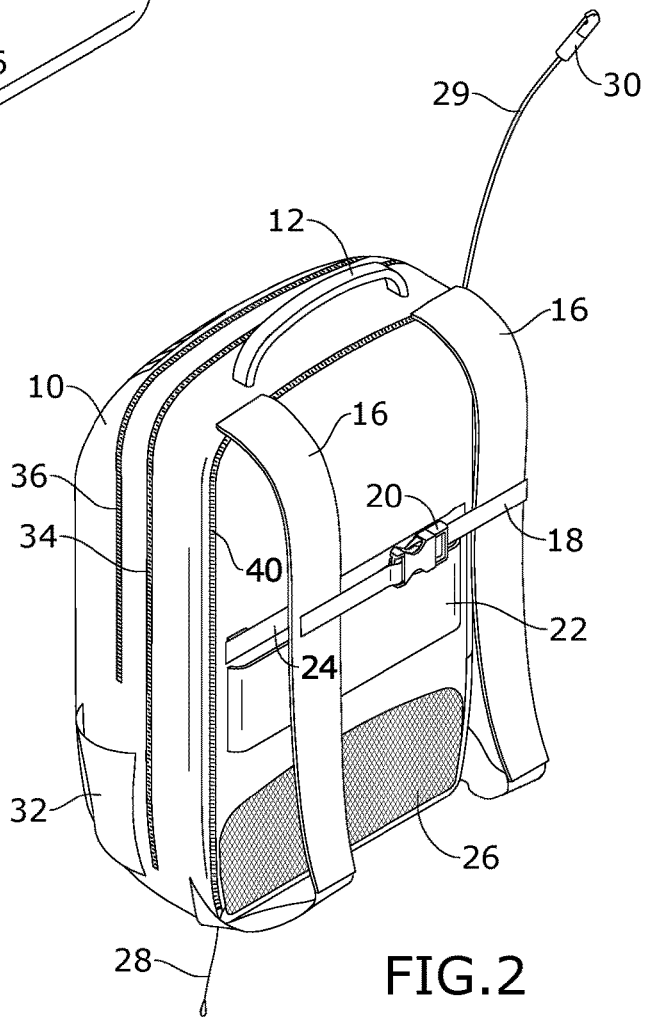
FIG. 2 is a rear perspective view of an embodiment of the present invention.
Figure 3:
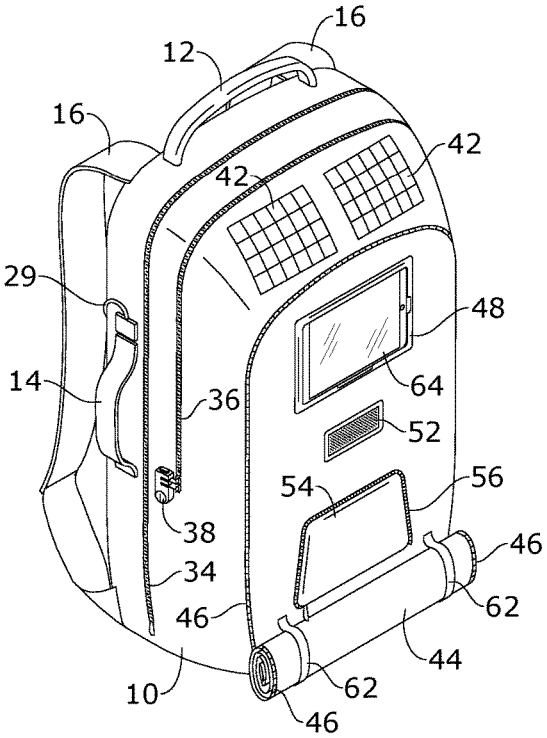
FIG. 3 is a front perspective view of an embodiment of the present invention, illustrating an opened cover.
Figure 4:
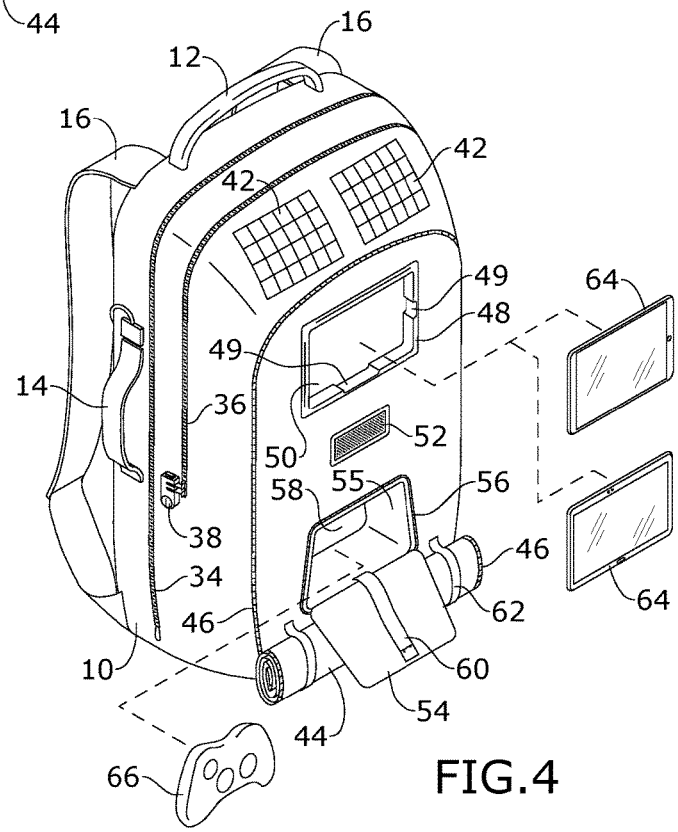
FIG. 4 is a front perspective view of an embodiment of the present invention, illustrating an opened cover and placement of a portable computer and controller.
Figure 5:
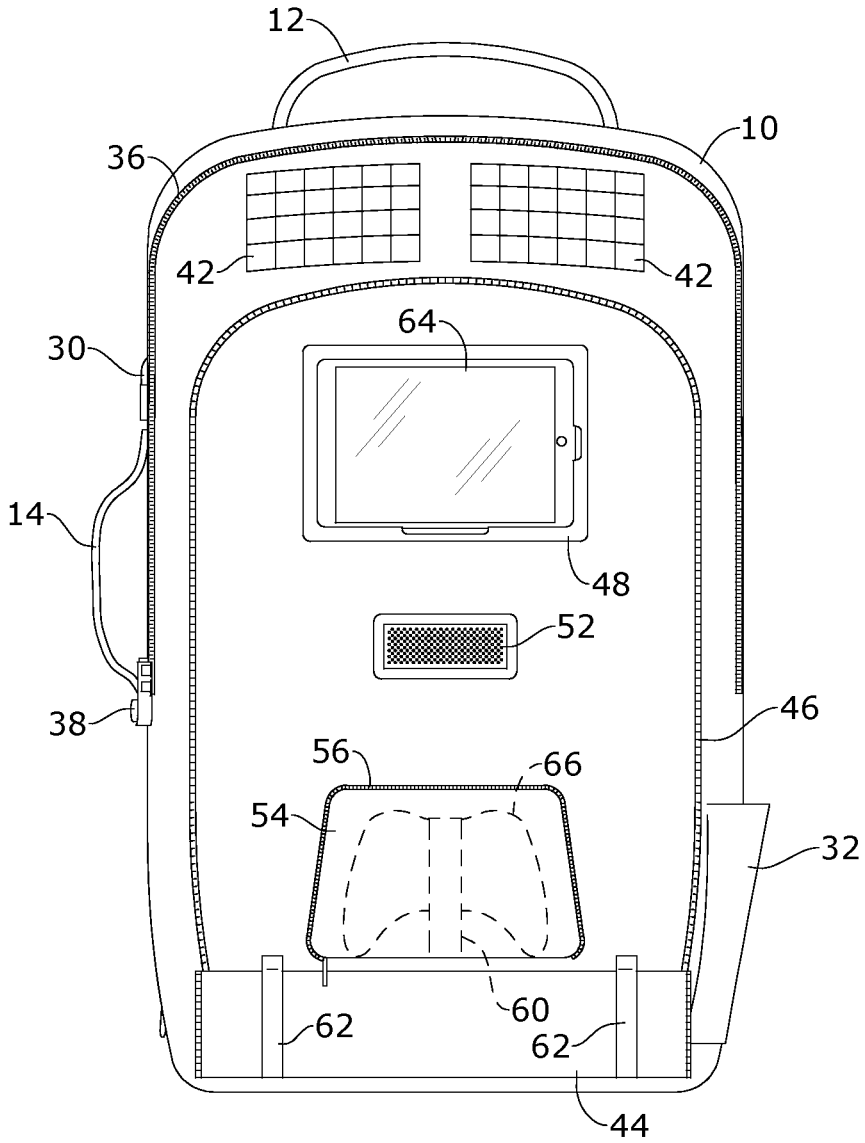
FIG. 5 is a front view of an embodiment of the present invention, illustrating an opened cover.

Referring to FIGS. 1 through 5, the present invention includes a backpack. The backpack includes a bag 10 having a front, a back, a top, a bottom, a first side, a second side and at least one inner compartment defined within. At least one connector 34 is operable to open and close an opening to the inner compartment of the bag 10. The backpack further includes at least one shoulder strap 16, such as a pair of shoulder straps 16, coupled to the bag 10 and disposed over the back of the bag 10. The term "coupled" mentioned above and below is defined as stitched, adhered, heat sealed, or the like. A frame 48 is coupled to the front of the bag 10. The frame 48 defines a slot 50. A portable computer 64, including a process, a memory, and a display screen, is retained to the frame 48 within the slot 50.

In certain embodiments, the backpack may include two internal compartments. In such embodiments, the backpack includes a back connector 34 and a front connector 36. The back connector 34 opens and closes an opening into a back internal compartment and the front connector 36 opens and closes an opening into a front internal compartment. The present invention may further include a flap connector 40 that opens and closes a laptop/tablet pocket approved by the TSA. The back, front, and flap connectors 34, 36, 40 may be zippers.

The backpack may include a plurality of handles, straps and pouches. For example, the backpack includes an upper handle 12 coupled to the top of the bag 10, and at least one side handle 14 coupled to one of the first side and the second side of the bag 10. In certain embodiments, the backpack may include sternum straps 18 connecting the pair of shoulder straps 16 together. The sternum straps 18 may connect together by a buckle 20. Additionally, the backpack may include a luggage handle strap 22 and a shoulder strap holder strap 24 coupled to the back of the bag 10. At least one pouch 32 may be coupled to one of the first side and the second side of the bag 10.

The frame 48 of the present invention may be made of a hard plastic and may include clips that releasably retain the portable computer 64 within the slot 50. The front zipper 36 may include a compartment to insert the portable computer 64 within the slot 50. Notches 49 may be formed along the perimeter of the frame 48 to correspond with buttons of the portable computer 64. The portable computer 64 may include a touchscreen and may be a smart phone, a tablet, or a handheld gaming device.

The present invention may further include a speaker 52 coupled to the bag 10. The speaker 52 may be coupled to the back of the bag 10 just below the frame 16. The speaker 52 is configured to be hard wired to the portable computer 64 or wirelessly connect with the portable computer 64. For example, the speaker 52 includes BLUETOOTH® technology which wirelessly connects with and plays sound from the portable computer 64.

The present invention may further include a second frame 55 coupled to the bag 10. The second frame 55 frame defines a second slot 58 sized to receive and retain a gaming controller 66 within. The gaming controller 66 is configured to wirelessly connect with the portable computer 64. For example, the gaming controller 66 includes BLUETOOTH® technology which wirelessly connects with the portable computer 64. To retain the gaming controller 66 within the second slot 58, the present invention may include a retaining strap 60 that wraps around the gaming controller 66 when it is disposed within the second slot 58. Additionally, the present invention may include a cover 54 and a cover connector 56, such as a zipper, snap buttons, or clips. The cover connector 56 is operable to connect the cover 54 to the bag 10 over an opening defined by the second frame 55, retaining the gaming controller 66 within the second slot 58.

The present invention may further include at least one solar panel 42, such as a pair of solar panels 42, coupled to the bag 10. The solar panels 42 are electrically connected through the frame 48 and configured to provide power to the portable computer 64 when the portable computer 64 is disposed within the slot 50 of the frame 48. The solar panels 42 may also be electrically connected to the speaker 52 and thereby may provide power the speaker 52.

In certain embodiments, the present invention includes a cover 44 to cover the frames 48, 55 and hides the portable computer 64. In such embodiments, the cover 44 is releasably retained to the back of the bag 10 by a connector 46, such as a zipper, snap buttons, or buckles. In such embodiments, the present invention includes cover securing straps 62 coupled to the bag 10 and operable to retain the cover 44 when the cover 44 is at least partially detached from the bag and in a rolled-up configuration.

The present invention may further include locks and a key leash 28. A mesh fabric 26 is coupled to the back of the bag 10. The mesh fabric 26 forms a pocket for a user's keys. A key leash 28 extends from the pocket and is releasably attachable to a user's keys or other valuables. The key leash 28 may be spring biased to retract into a pocket defined by the mesh fabric 26. As mentioned above, the present invention further includes locks. One lock may include a metal wire 29 and a padlock 30. A first end of the wire 29 is attached to the bag 10 and the padlock 30 is attached to a second end of the wire 29. The present invention may further include a zipper lock 38 preventing unknown user's from opening the connectors 34, 36 and accessing the internal compartments of the bag 10.

It should be understood, of course, that the foregoing relates to exemplary embodiments of the invention and that modifications may be made without departing from the spirit and scope of the invention as set forth in the following claims.

What is claimed is:

1. A backpack comprising:

a bag comprising a front, a back, a top, a bottom, a first side and a second side;

at least one connector operable to open and close an opening to an inner compartment of the bag;

at least one shoulder strap coupled to the bag and disposed over the back of the bag;

a rigid frame coupled to the front of the bag, wherein the frame defines a slot comprising a clip;

a portable computer comprising a processor, a memory and a display screen, wherein the portable computer is releasably retained to the frame within the slot by the clip;

a second frame coupled to the bag, wherein the second frame defines a second slot; and a gaming controller disposed within the second slot, wherein the gaming controller wirelessly connects with the portable computer.

2. The backpack of claim 1, wherein the portable computer is a tablet computer.

3. The backpack of claim 1, further comprising a speaker coupled to the bag and configured play sound from the portable computer.

4. The backpack of claim 1, further comprising a cover and a cover connector, wherein the cover connector is operable to connect the cover to the bag over an opening defined by the second frame.

5. The backpack of claim 1, further comprising at least one solar panel coupled to the bag, wherein the at least one solar panel is configured to provide power to the portable computer.

6. The backpack of claim 1, further comprising a cover releasably retained to the back of the bag by a second connector covering the portable computer.

7. The backpack of claim 6, further comprising cover securing straps coupled to the bag and operable to retain the cover when the cover is at least partially detached from the bag and in a rolled-up configuration.

8. A backpack comprising:

a bag comprising a front, a back, a top, a bottom, a first side and a second side;

at least one connector operable to open and close an opening to an inner compartment of the bag;

at least one shoulder strap coupled to the bag and disposed over the back of the bag;

a rigid frame coupled to the front of the bag, wherein the frame defines a slot;

a portable computer comprising a processor, a memory and a display screen, wherein the portable computer is releasably retained to the frame within the slot; and at least one solar panel coupled to the bag, wherein the at least one solar panel electrically connects to the rigid frame, thereby providing power to the portable computer.

* * * * *